US012668343B2

(12) United States Patent
Takeda

(10) Patent No.: US 12,668,343 B2
(45) Date of Patent: Jun. 30, 2026

(54) SHIP PROPULSION DEVICE AND BATTERY TEMPERATURE ADJUSTMENT METHOD

(71) Applicant: Panasonic Intellectual Property Management Co., Ltd., Osaka (JP)

(72) Inventor: Mutsuhiko Takeda, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 402 days.

(21) Appl. No.: 18/262,203

(22) PCT Filed: Jan. 7, 2022

(86) PCT No.: PCT/JP2022/000425
§ 371 (c)(1),
(2) Date: Jul. 20, 2023

(87) PCT Pub. No.: WO2022/163331
PCT Pub. Date: Aug. 4, 2022

(65) Prior Publication Data

US 2024/0174336 A1 May 30, 2024

(30) Foreign Application Priority Data

Jan. 29, 2021 (JP) ..... 2021-013079

(51) Int. Cl.
*B63H 20/28* (2006.01)
*B63H 21/17* (2006.01)

(52) U.S. Cl.
CPC ..... *B63H 20/28* (2013.01); *B63H 21/17* (2013.01)

(58) Field of Classification Search
CPC ..... B63H 20/28; B63H 21/17
See application file for complete search history.

(56) References Cited

U.S. PATENT DOCUMENTS 6,149,478 A * 11/2000 Lehmann ..... F01P 3/202 440/88 R
8,535,104 B1 * 9/2013 Nida ..... B63H 21/383 62/3.61

(Continued)

FOREIGN PATENT DOCUMENTS

CN 103723263 B 6/2016
CN 109560345 A 4/2019

(Continued)

OTHER PUBLICATIONS

International Search Report of PCT application No. PCT/JP2022/000425 dated Mar. 1, 2022.

(Continued)

*Primary Examiner* — Stephen P Avila
(74) *Attorney, Agent, or Firm* — WHDA, LLP

(57) ABSTRACT

A ship propulsion device includes: a motor; a battery; a temperature-adjustment-water flow path including a first route passing through a first exchanger capable of exchanging heat with the battery; a route switch unit switchable between a state which permits a flow of water to the first route and a state which restricts the flow of the water to the first route; a first temperature sensor which detects a temperature of the battery; a second temperature sensor which detects a temperature of the water; and a controller which controls the route switch unit utilizing the temperatures detected.

2 Claims, 4 Drawing Sheets

(56) References Cited

U.S. PATENT DOCUMENTS

| | | | | |
|---|---|---|---|---|
| 2014/0202178 | A1* | 7/2014 | Trumbower ..... | B60H 1/00278 62/509 |
| 2015/0232163 | A1 | 8/2015 | Hartmeyer et al. | |
| 2017/0279172 | A1 | 9/2017 | Tucker | |
| 2019/0092186 | A1 | 3/2019 | Tominaga et al. | |

FOREIGN PATENT DOCUMENTS

| | | | |
|---|---|---|---|
| JP | 4337522 | B2 | 9/2009 |
| JP | 2017-174792 | | 9/2017 |
| KR | 2016-0046354 | A | 4/2016 |

OTHER PUBLICATIONS

Extended Supplementary European Search Report dated Jul. 10, 2024, issued in counterpart Application No. 22745558.1. (10 pages).
English translation of Search Report dated Sep. 10, 2025, issued in counterpart CN Application No. 202280011765.8. (3 pages).

* cited by examiner

1

SHIP PROPULSION DEVICE AND BATTERY TEMPERATURE ADJUSTMENT METHOD

CROSS-REFERENCE TO RELATED APPLICATIONS

This application is a U.S. national stage application of the PCT International Application No. PCT/JP2022/000425 filed on Jan. 7, 2022, which claims the benefit of foreign priority of Japanese patent application No. 2021-013079 filed on Jan. 29, 2021, the contents all of which are incorporated herein by reference.

TECHNICAL FIELD

The present disclosure relates to a ship propulsion device and a battery temperature adjustment method.

BACKGROUND ART

Ship propulsion devices, such as outboard motors, generally use an internal combustion engine, such as a gasoline engine, as a power source. On the other hand, in recent years, a ship propulsion device using an electric motor as a power source has been attracting attention from the viewpoint of reducing the environmental load or the like. Regarding an electric ship propulsion device, for example, Patent Literature (PTL) 1 discloses a technique for taking in water from the outside to cool a battery.

CITATION LIST

Patent Literature

[PTL 1] Japanese Unexamined Patent Application Publication No. 2017-174792

SUMMARY OF THE INVENTION

As a result of intensive studies, the inventors of the present invention have found that there is room for improving the performance of conventional electric ship propulsion devices in terms of battery temperature adjustment.

The present disclosure has been conceived in view of such a situation. One of the objects of the present disclosure is to provide a technique for improving the performance of an electric ship propulsion device.

An aspect of the present disclosure is a ship propulsion device. The ship propulsion device includes: a motor which drives a propulsion unit; a battery which supplies electric power to the motor; a temperature-adjustment-water flow path through which water outside a hull flows, the temperature-adjustment-water flow path including a first route which passes through a first exchanger connected to the battery in a heat exchangeable manner; a route switch unit switchable between a permitted state and a restricted state, the permitted state permitting a flow of the water to the first route, the restricted state restricting the flow of the water to the first route; a first temperature sensor which detects a temperature of the battery; a second temperature sensor which detects a temperature of the water; and a controller which controls the route switch unit based on the temperature of the battery detected by the first temperature sensor and the temperature of the water detected by the second temperature sensor. The controller: sets the route switch unit to the permitted state at least one of (i) when the temperature of the battery exceeds a predetermined upper limit value and the temperature of the water is lower than the temperature of the battery or (ii) when the temperature of the battery is lower than a predetermined lower limit value and the temperature of the water exceeds the temperature of the battery; and sets the route switch unit to the restricted state at least one of (i) when the temperature of the battery exceeds the predetermined upper limit value and the temperature of the water exceeds the temperature of the battery, or (ii) when the temperature of the battery is lower than the predetermined lower limit value and the temperature of the water is lower than the temperature of the battery.

Another aspect of the present disclosure is a method of adjusting a temperature of a battery provided in a ship propulsion device. The method includes: performing heat exchange between water outside a hull and the battery at least one of (i) when the temperature of the battery exceeds a predetermined upper limit value and a temperature of the water is lower than the temperature of the battery, or (ii) when the temperature of the battery is lower than a predetermined lower limit value and the temperature of the water exceeds the temperature of the battery; and reducing the heat exchange at least one of (i) when the temperature of the battery exceeds the predetermined upper limit value and the temperature of the water exceeds the temperature of the battery, or (ii) when the temperature of the battery is lower than the predetermined lower limit value and the temperature of the water is lower than the temperature of the battery.

It should be noted that any combination of the above-described structural elements and results of conversion of the representation of the present disclosure between methods, devices, systems, and the like are also effective as aspects of the present disclosure.

According to the present disclosure, it is possible to improve the performance of an electric ship propulsion device.

DESCRIPTION OF EMBODIMENT

Figure 1:
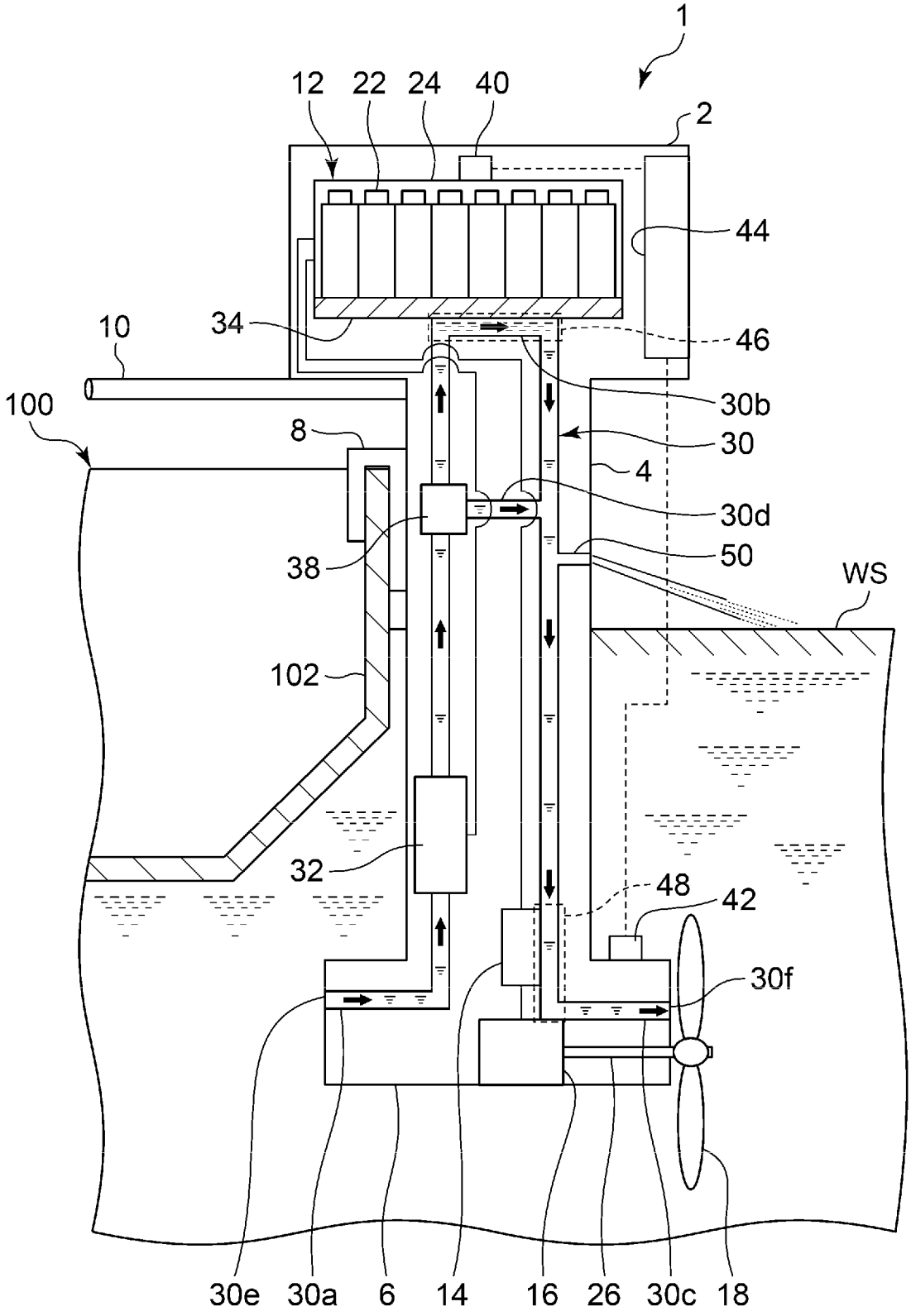
FIG. 1 is a schematic diagram of a ship propulsion device.

Hereinafter, the present disclosure will be described based on a preferred embodiment with reference to the drawings. The embodiment does not limit the present disclosure, but is merely an example, and all the features and the combinations of them described in the embodiment are not necessarily essential to the present disclosure. The same or equivalent structural elements, members, and processes illustrated in each drawing are denoted by the same reference numerals, and duplicated descriptions will be omitted as appropriate. In addition, the scale and shape of each part illustrated in each drawing are set for convenience in order to facilitate the explanation, and should not be construed as limiting unless otherwise mentioned. In addition, when terms such as "first" and "second" are used in the description or claims, unless otherwise specified, these terms do not represent any order or degree of importance, but are to distinguish one configuration from another configuration. In each drawing, some of the members that are not important for explaining the embodiment are omitted.

FIG. 1 is a schematic diagram of ship propulsion device 1. Ship propulsion device 1 according to the present embodiment is an outboard motor as an example. Note that ship propulsion device 1 may be an inboard motor or an inboard and outboard motor. Ship propulsion device 1 includes upper housing 2, intermediate housing 4, and lower housing 6. Upper housing 2 is in a generally rectangular shape, and is positioned higher than water surface WS. Lower housing 6 is positioned lower than water surface WS. Intermediate housing 4 is tubular in shape and extends in an up and down direction. Intermediate housing 4 connects upper housing 2 and lower housing 6. Bracket device 8 is provided on intermediate housing 4. Ship propulsion device 1 is supported by hull 100 via bracket device 8. In the present embodiment, ship propulsion device 1 is attached to transom 102 of hull 100.

Ship propulsion device 1 is capable of rotating horizontally and vertically. Steering handle 10 extending toward hull 100 is provided on upper housing 2. By swinging steering wheel 10 in the horizontal direction, a crew of the ship is able to change the orientation of ship propulsion device 1 to steer hull 100. A throttle grip for adjusting the output of motor 16 is provided at the tip of steering handle 10. Moreover, steering handle 10 includes a shift switch for switching between forward rotation and reverse rotation of motor 16.

Ship propulsion device 1 also includes: battery 12, power converter 14, motor 16, and propulsion unit 18. Battery 12 is housed in upper housing 2. Preferably, battery 12 is detachably housed in upper housing 2. Battery 12 includes a plurality of batteries 22 and battery pack 24. Batteries 22 are connected in series and/or in parallel with each other, and are housed in battery pack 24. Battery pack 24 is a container made of metal or resin. Battery pack 24 is preferably waterproof. Note that the number of batteries 22 may be one.

Battery 22 as an example is a rechargeable secondary battery, such as a lithium ion battery, a nickel-hydrogen battery, or a nickel-cadmium battery. Battery 22 includes a known configuration. As an example, battery 22 includes a configuration in which an electrode group and a non-aqueous electrolyte are housed in an outer covering can. The outer covering can includes a safety valve. The safety valve opens when the internal pressure of the outer covering can rises to a value that is higher than or equal to a predetermined value. With this, the gas inside battery 22 can be released.

Battery 12 supplies electric power to motor 16 via power converter 14. As an example, power converter 14 is housed in intermediate housing 4 or lower housing 6, and motor 16 is housed in lower housing 6. Note that power converter 14 and motor 16 may be integrated. Power converter 14 may be omitted. Power converter 14 converts the electric power of battery 12, and supplies the converted power to motor 16. For example, power converter 14 is an inverter, and controls the voltage and frequency of battery 12 to change the output and the like of motor 16. The configuration of motor 16 is not particularly limited as long as motor 16 is capable of converting the electric power supplied from battery 12 into power.

Propulsion unit 18 is connected to motor 16. Propulsion unit 18 can be driven by motor 16 being driven by the electric power supplied from battery 12. Propulsion unit 18 according to the present embodiment is a propeller, and is connected to the output shaft of motor 16 via propeller shaft 26. Propulsion unit 18 may be a known propulsion unit other than a propeller, such as a water jet propulsion unit. Power converter 14 and motor 16 may be housed in upper housing 2. In this case, the output shaft of motor 16 and propeller shaft 26 are connected to each other via a drive shaft housed in intermediate housing 4.

Ship propulsion device 1 also includes temperature-adjustment-water flow path 30, pump 32, heat exchange member 34, route switch unit 38, first temperature sensor 40, second temperature sensor 42, and controller 44. Temperature-adjustment-water flow path 30 is a conduit through which temperature adjustment water, which is water for adjusting the temperature of battery 12, flows. In the present embodiment, the temperature adjustment water is the water outside hull 100. In other words, the water (seawater, lake water, river water, or the like) on which hull 100 is floating is used as the temperature adjustment water.

Temperature-adjustment-water flow path 30 extends from the inside of upper housing 2 to the inside of lower housing 6. Temperature-adjustment-water flow path 30 includes first flow path 30*a*, second flow path 30*b*, third flow path 30*c*, and fourth flow path 30*d*. First flow path 30*a* extends from the inside of lower housing 6 to the inside of upper housing 2. First flow path 30*a* includes a first end that is disposed in lower housing 6 and communicated with the water to form inlet 30*e* for temperature adjustment water. First flow path 30*a* extends upward in intermediate housing 4, and reaches the inside of upper housing 2. Pump 32 is provided at a point along first flow path 30*a*. A known pump can be used as pump 32. Pump 32 is driven by the electric power supplied from battery 12, and pumps up the temperature adjustment water from the first end of first flow path 30*a*. Pump 32 may be provided in third flow path 30*c*. Alternatively, pump 32 may be driven by rotation of motor 16 or rotation of the drive shaft.

Second flow path 30*b* is provided in upper housing 2. First flow path 30*a* includes a second end that is connected to a first end of second flow path 30*b*. Second flow path 30*b* is connected to heat exchange member 34 in a heat exchangeable manner. Heat exchange member 34 is connected to battery 12 in a heat exchangeable manner. Accordingly, second flow path 30*b* is capable of exchanging heat with battery 12 via heat exchange member 34. At least part of second flow path 30*b* forms first heat exchanger 46 which is connected to battery 12 in a heat exchangeable manner.

A known heat exchange member can be used as heat exchange member 34. For example, heat exchange member 34 is made of a plate material with high thermal conductivity, such as a metal plate. Second flow path 30*b* is fixed to one main surface of heat exchange member 34 with a thermally conductive adhesive or the like. Second flow path 30*b* and heat exchange member 34 may be screwed while being in a direct contact with each other or a heat transfer material is interposed therebetween, or may be fixed by joining such as welding or brazing. Battery 12 is provided on the other main surface of heat exchange member 34, and the bottom surface of battery pack 24 is in contact with heat exchange member 34. The method of connecting second flow path 30*b* and battery 12 in a heat exchangeable manner is not limited to the above example. For example, heat exchange member 34 may be omitted.

Third flow path 30*c* extends from the inside of upper housing 2 to the inside of lower housing 6. Third flow path 30*c* includes a first end that is disposed in upper housing 2, and is connected to a second end of second flow path 30*b*. Third flow path 30*c* extends downward in intermediate housing 4, and reaches the inside of lower housing 6. Third flow path 30*c* includes a second end that is disposed in lower housing 6 and is communicated with the water to form outlet 30*f* for temperature adjustment water.

In the present embodiment, power converter 14 is connected to third flow path 30*c* in a heat exchangeable manner. Accordingly, at least part of third flow path 30*c* forms second heat exchanger 48 which is connected to power converter 14 in a heat exchangeable manner. Moreover, in the present embodiment, motor 16 is also connected to second heat exchanger 48 in a heat exchangeable manner. Each of power converter 14 and motor 16 can be connected to third flow path 30*c* in a heat exchangeable manner in a method similar to the method of connecting second flow path 30*b* and heat exchange member 34. Note that the thermal connection of power converter 14 and motor 16 to second heat exchanger 48 may be made arbitrarily.

The outside water as temperature adjustment water pumped from the first end of first flow path 30*a* by pump 32 passes through first flow path 30*a*, second flow path 30*b*, and third flow path 30*c*, and is discharged from the second end of third flow path 30*c*. The temperature adjustment water exchanges heat with battery 12 while passing through first heat exchanger 46. With this, battery 12 is cooled or heated. Moreover, the temperature adjustment water draws heat from power converter 14 and motor 16 while passing through second heat exchanger 48. This cools power converter 14 and motor 16.

Pilot water outlet 50 is provided at a point along third flow path 30*c*. Pilot water outlet 50 is positioned above water surface WS. In the present embodiment, pilot water outlet 50 is positioned above second heat exchanger 48 (positioned on the upstream side of the flow of the temperature adjustment water). Part of the temperature adjustment water which has cooled or heated battery 12 in first heat exchanger 46 is discharged through pilot water outlet 50 to water surface WS. This allows the crew of the ship to visually confirm that the temperature adjustment mechanism is operating normally.

Fourth flow path 30*d* is provided, for example, in intermediate housing 4. Fourth flow path 30*d* includes a first end that is connected to a point along first flow path 30*a*. Fourth flow path 30*d* includes a second end that is connected to a point along third flow path 30*c*. The connection position between the second end of fourth flow path 30*d* and third flow path 30*c* is positioned, for example, above pilot water outlet 50. By causing the temperature adjustment water to flow from first flow path 30*a* to third flow path 30*c* via fourth flow path 30*d*, the temperature adjustment water can be led to outlet 30*f* without passing through first heat exchanger 46. Note that the temperature adjustment water flowing through fourth flow path 30*d* also passes through second heat exchanger 48. Accordingly, power converter 14 and motor 16 can be cooled regardless of whether the temperature adjustment water flows through second flow path 30*b* or fourth flow path 30*d*.

The first end of fourth flow path 30*d* is connected to first flow path 30*a* via route switch unit 38. Route switch unit 38 is capable of switching whether to deliver the temperature adjustment water flowing from inlet 30*e* to second flow path 30*b* or to fourth flow path 30*d*. Route switch unit 38 can be configured with a known flow path switch solenoid valve or the like, and the state of route switch unit 38 is switched in response to a control signal output from controller 44.

First temperature sensor 40 detects the temperature of battery 12. First temperature sensor 40 can be configured with a known temperature sensor, such as a thermistor. The measurement position of the battery temperature, that is, the position where first temperature sensor 40 is provided relative to battery 12 can be appropriately set based on experiments, simulations, and the like conducted by a designer. First temperature sensor 40 transmits the detection result to controller 44.

Second temperature sensor 42 detects the temperature of the outside water. Second temperature sensor 42 can be configured with a known temperature sensor, such as a thermistor. The measurement position of the water temperature can be appropriately set based on experiments, simulations, and the like conducted by the designer. Second temperature sensor 42 transmits the detection result to controller 44.

Controller 44 controls route switch unit 38 based on the battery temperature detected by first temperature sensor 40 and the water temperature detected by second temperature sensor 42. Controller 44 is realized by elements and circuits, such as a central processing unit (CPU) and memory of a computer as a hardware configuration, and is realized by a computer program or the like as a software configuration. In FIG. 1, controller 44 is illustrated as a functional block realized by the cooperation of hardware and software configurations. It should be understood by those skilled in the art that this functional block can be realized in various ways by a combination of hardware and software.

Figure 2:
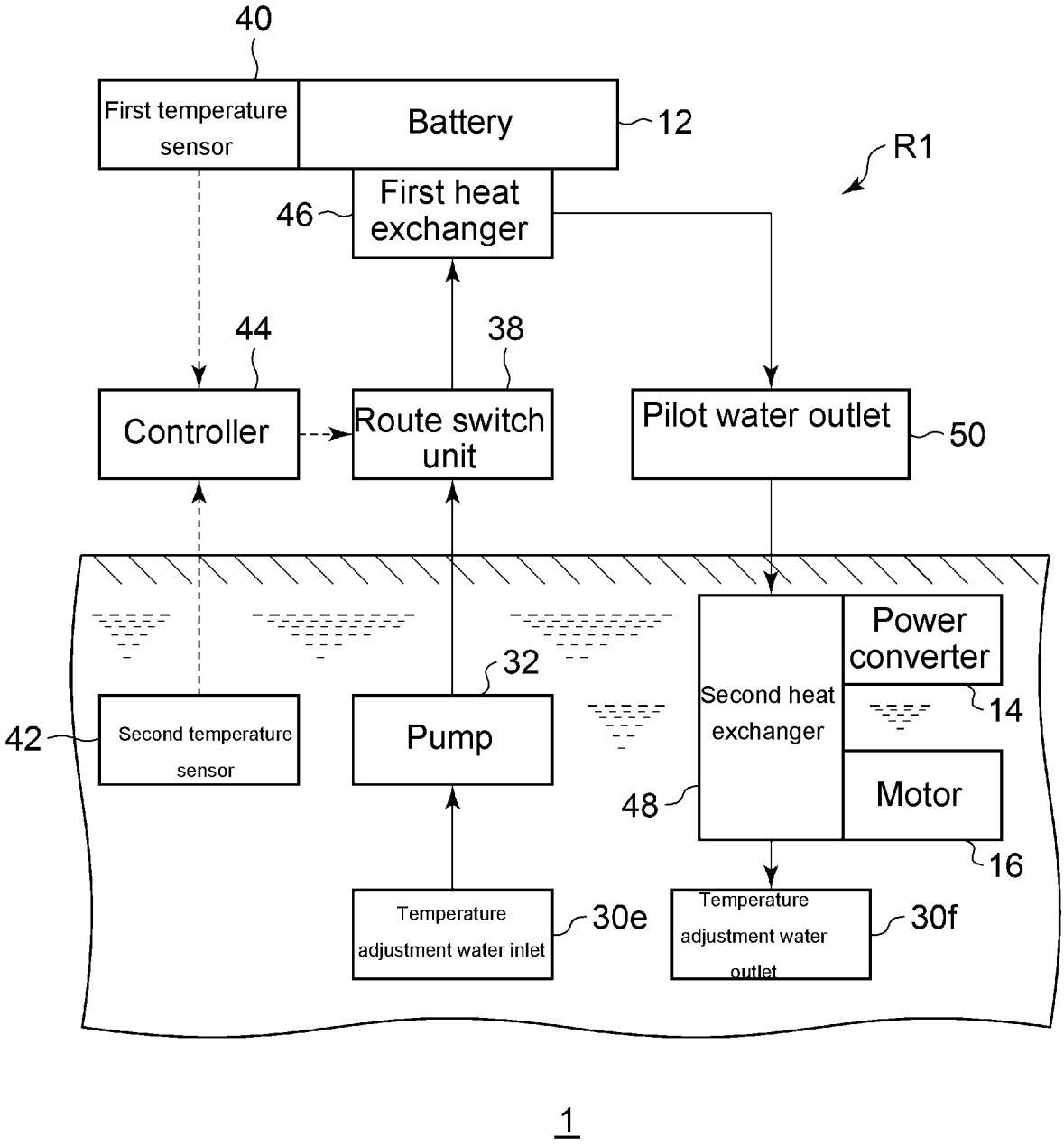
FIG. 2 is a schematic diagram illustrating a first route of temperature adjustment water.
Figure 3:
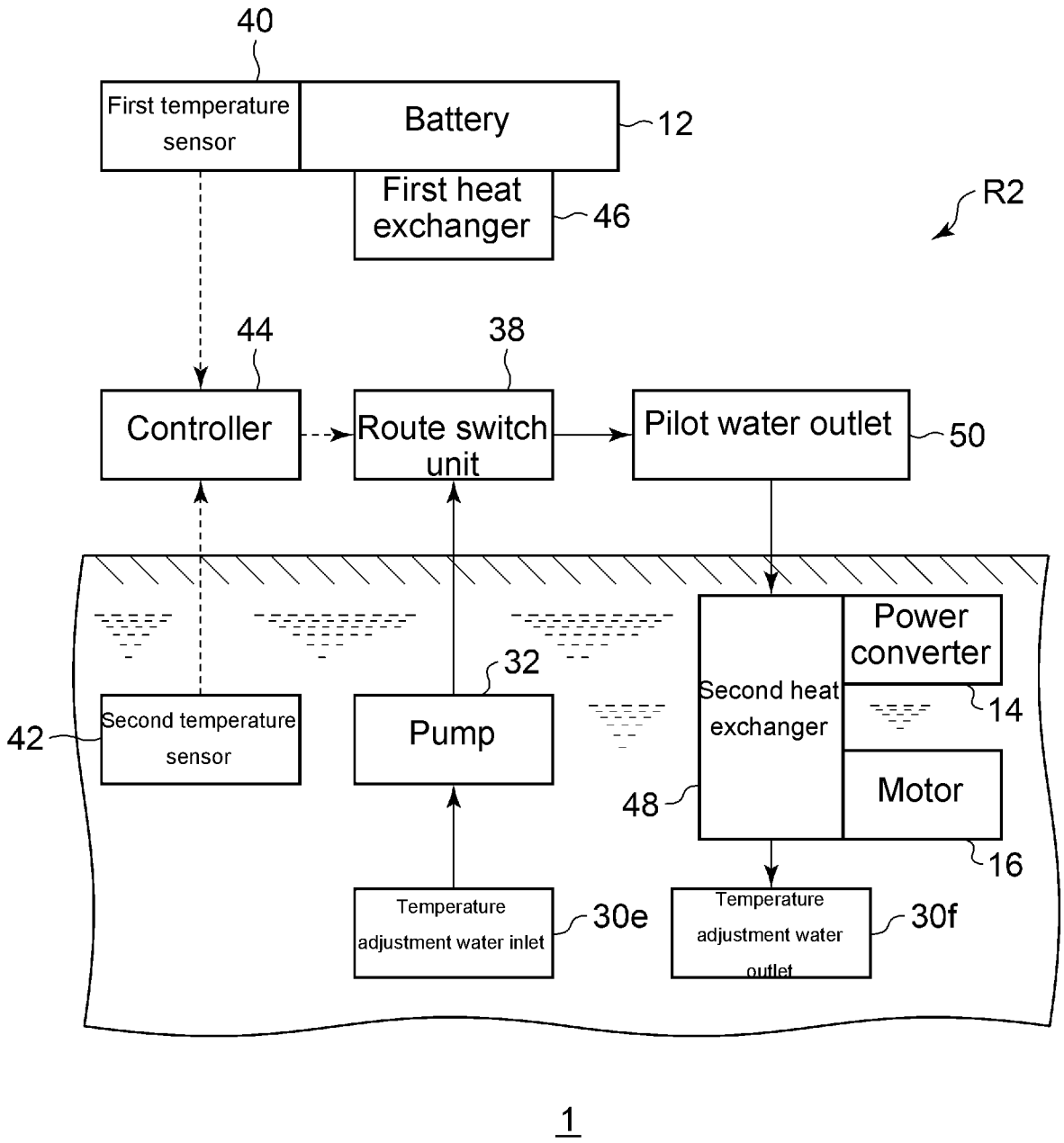
FIG. 3 is a schematic diagram illustrating a second route of temperature adjustment water.

Next, the temperature adjustment control of battery 12 performed by controller 44, that is, the switching control of the temperature adjustment water route will be described. FIG. 2 is a schematic diagram illustrating first route R1 of the temperature adjustment water. FIG. 3 is a schematic diagram illustrating second route R2 of the temperature adjustment water. Temperature-adjustment-water flow path 30 includes first route R1 and second route R2. First route R1 is a route passing through first heat exchanger 46 as illustrated in FIG. 2. First route R1 according to the present embodiment passes through second heat exchanger 48 in addition to first heat exchanger 46. As illustrated in FIG. 3, second route R2 is a route which does not pass through first heat exchanger 46, but passes through second heat exchanger 48.

First route R1 includes part of first flow path 30*a* positioned downstream (positioned closer to the second flow path 30*b* than route switch unit 38) of route switch unit 38, second flow path 30*b*, and third flow path 30*c*. In first route R1, the temperature adjustment water is discharged through outlet 30*f* after passing through first heat exchanger 46, pilot water outlet 50, and second heat exchanger 48. Accordingly, the temperature adjustment water exchanges heat with battery 12, power converter 14, and motor 16.

Second route R2 includes fourth flow path 30*d*, and part of third flow path 30*c* positioned downstream (positioned closer to the outlet 30*f* than the connecting portion with fourth flow path 30*d*) of the connecting portion with fourth flow path 30*d*. In second route R2, the temperature adjustment water is discharged through outlet 30*f* after passing through pilot water outlet 50 and second heat exchanger 48. Accordingly, the temperature adjustment water does not exchange heat with battery 12, but exchanges heat with power converter 14 and motor 16.

Route switch unit 38 is switchable between a permitted state which permits the flow of water to first route R1 and a restricted state which restricts the flow. As described above, route switch unit 38 according to the present embodiment connects first flow path 30*a* and fourth flow path 30*d*, and when the temperature adjustment water is not delivered to second flow path 30*b*, the temperature adjustment water is delivered to fourth flow path 30*d*. Accordingly, route switch unit 38 according to the present embodiment switches the route of the temperature adjustment water between first route R1 and second route R2. Hence, the flow of water to second route R2 is restricted when route switch unit 38 is in the permitted state, and the flow of water to second route R2 is permitted when route switch unit 38 is in the restricted state. Note that the position where route switch unit 38 is provided is not limited as long as route switch unit 38 is capable of switching between the permitted state and the restricted state. For example, route switch unit 38 may be provided in third flow path 30*c*.

"Restricting the flow of water" means reducing the flow rate of water compared to when the flow of water is permitted. Hence, when route switch unit 38 is in the restricted state, a smaller amount of water may flow to first route R1 than when route switch unit 38 is in the permitted state. However, it is preferable that the flow rate of water to first route R1 in the restricted state is zero.

Controller 44 switches between first route R1 and second route R2 based on the magnitude relationship between the battery temperature detected by first temperature sensor 40 and the water temperature detected by second temperature sensor 42. Specifically, controller 44 stores, in advance, predetermined upper and lower limit values for the battery temperature. The upper and lower limit values of the battery temperature can be appropriately set based on experiments, simulations, and the like conducted by the designer according to the temperature range and the like suitable for maintaining the performance of battery 12 and extending the life of battery 12. For example, the upper limit value is 30° C., and the lower limit value is 25° C.

At least one of when the battery temperature exceeds the predetermined upper limit value and the water temperature is lower than the battery temperature, or when the battery temperature is lower than the predetermined lower limit value and the water temperature exceeds the battery temperature, controller 44 sets route switch unit 38 to the permitted state. Preferably, controller 44 sets route switch unit 38 to the permitted state both when the battery temperature exceeds the upper limit value and the water temperature is lower than the battery temperature and when the battery temperature is lower than the lower limit value and the water temperature exceeds the battery temperature.

As a result, the temperature adjustment water is capable of effectively cooling battery 12 whose temperature exceeding the appropriate temperature range. In addition, the temperature adjustment water is capable of effectively heating battery 12 whose temperature is lower than the appropriate temperature range. By heating battery 12, the internal resistance of battery 22 can be reduced, and the input and output characteristics of battery 12 can be improved, leading to an improved power consumption. In addition, deterioration of battery 22 can be reduced by reducing opportunities for regeneration and charging of battery 12 that is in a low temperature state.

Controller 44 sets route switch unit 38 to the restricted state at least one of when the battery temperature exceeds the upper limit value and the water temperature exceeds the battery temperature, or when the battery temperature is lower than the lower limit value and the water temperature is lower than the battery temperature. Preferably, controller 44 sets route switch unit 38 to the restricted state both when the battery temperature exceeds the upper limit value and the water temperature exceeds the battery temperature and when the battery temperature is lower than the lower limit value and the water temperature is lower than the battery temperature.

As a result, it is possible to avoid that an attempt to cool battery 12 whose temperature exceeds the appropriate temperature range using the temperature adjustment water unintentionally increases the battery temperature, or battery 12 whose temperature falls below the appropriate temperature range is further cooled by the temperature adjustment water. When the battery temperature exceeds the upper limit value and the water temperature exceeds the battery temperature, battery 12 is cooled by air cooling or the like. Moreover, when the battery temperature is lower than the lower limit value and the water temperature is lower than the battery temperature, battery 12 is heated by self-heating or the like due to discharge of battery 12.

When the battery temperature exceeds the upper limit value and the water temperature is equal to the battery temperature, and when the battery temperature is lower than the lower limit value and the water temperature is equal to the battery temperature, route switch unit 38 may be set to the permitted state or to the restricted state. Moreover, when the battery temperature is higher than or equal to the lower limit value, and is lower than or equal to the upper limit value, that is, when the battery temperature is within the appropriate temperature range, as an example, controller 44 sets route switch unit 38 to the restricted state. With this, the temperature adjustment of battery 12 using the temperature adjustment water is reduced. Route switch unit 38 may be set to the permitted state when the temperature of the battery is within the appropriate temperature range.

Regardless of whether route switch unit 38 is in the permitted state or the restricted state, in other words, regardless of which of first route R1 and second route R2 is selected, the temperature adjustment water passes through second heat exchanger 48. Accordingly, power converter 14 and motor 16 constantly exchange heat with the temperature adjustment water. Generally, the temperatures of power converter 14 and motor 16 during operation are always higher than the temperature that the outside water can take. Moreover, there is virtually no possibility that the temperatures of power converter 14 and motor 16 will deviate from the appropriate temperature range due to heat exchange with water. Accordingly, no problem occurs even if the water always flows through second heat exchanger 48 regardless of the water temperature.

As described above, ship propulsion device 1 according to the present embodiment includes: motor 16 which drives propulsion unit 18; battery 12 which supplies electric power to motor 16; temperature-adjustment-water flow path 30 through which water outside hull 100 flows and which includes first route R1 passing through first heat exchanger 46 connected to battery 12 in a heat exchangeable manner; route switch unit 38 which is switchable between a permitted state which permits water flow to first route R1 and a restricted state which restricts the water flow; first temperature sensor 40 which detects the temperature of battery 12; second temperature sensor 42 which detects the temperature of the outside water; and controller 44 which controls route switch unit 38 based on the battery temperature detected by first temperature sensor 40 and the water temperature detected by second temperature sensor 42.

At least one of when the battery temperature exceeds the predetermined upper limit value and the water temperature is lower than the battery temperature, or when the battery temperature is lower than the predetermined lower limit value and the water temperature exceeds the battery temperature, controller 44 sets route switch unit 38 to the permitted state. At least one of when the battery temperature exceeds the upper limit value and the water temperature exceeds the battery temperature, or when the battery temperature is lower than the lower limit value and the water temperature is lower than the battery temperature, controller 44 sets route switch unit 38 to the restricted state.

The temperature of a general internal combustion engine, such as a gasoline engine, which is provided in a conventional ship propulsion device, becomes higher than the temperature of the outside water during operation. Moreover, there is virtually no possibility that the temperature of the internal combustion engine will deviate from the appropriate temperature range due to heat exchange with water. For this reason, in the conventional ship propulsion device, the internal combustion engine is always cooled by the outside water during operation. On the other hand, the temperature of battery 12 provided in electric ship propulsion device 1 may deviate from the appropriate temperature range due to heat exchange with the outside water, depending on the water temperature.

In contrast, in ship propulsion device 1 according to the present embodiment, when the temperature of battery 12 exceeds the predetermined upper limit value and the temperature of the water is lower than the temperature of battery 12, or when the temperature of the battery is lower than the predetermined lower limit value and the temperature of the water exceeds the temperature of battery 12, heat exchange is performed between the water and battery 12. Moreover, at least one of when the temperature of battery 12 exceeds the upper limit value and the temperature of the water exceeds the temperature of battery 12, or when the temperature of battery 12 is lower than the lower limit value and the temperature of the water is lower than the temperature of battery 12, heat exchange between the water and battery 12 is reduced. With this, the battery temperature can be easily maintained within a temperature range suitable for maintaining the battery performance and extending the life of the battery. As a result, the output of battery 12 can be stabilized, and the life of battery 12 can be extended. Accordingly, the performance of electric ship propulsion device 1 can be improved.

Moreover, ship propulsion device 1 according to the present embodiment includes power converter 14 which converts the electric power of battery 12 and supplies the converted power to motor 16. Temperature-adjustment-water flow path 30 also includes second route R2 which does not pass through first heat exchanger 46 but passes through second heat exchanger 48 that is connected to power converter 14 in a heat-exchangeable manner. Route switch unit 38 permits water flow to second route R2 in the restricted state. With this, the water that is no longer used for heat exchange with battery 12 can be used for cooling power converter 14, so that the performance of ship propulsion device 1 can be further improved.

Moreover, first route R1 according to the present embodiment passes through second heat exchanger 48 in addition to first heat exchanger 46. With this, power converter 14 can always be cooled regardless of whether the outside water passes through first route R1 or second route R2. Accordingly, the performance of ship propulsion device 1 can be further improved.

The embodiment according to the present disclosure has been described in detail above. The embodiment described above merely shows specific examples for carrying out the present disclosure. The details of the embodiment do not limit the technical scope of the present disclosure, and many design changes, such as changes, additions, and deletions of structural elements are possible within the scope that does not deviate from the spirit of the present disclosure defined in the scope of claims. New embodiments with design changes will provide the combined advantages of the embodiment and the modification. Although the details subject to such design changes are emphasized in the embodiment by using phrases such as "according to the present embodiment" and "in the present embodiment", details not referred to as such are also subject to design changes. Any combination of the above structural elements is also effective as an aspect of the present disclosure. The hatching in the cross section of each drawing does not limit the material of the hatched object.

Figure 4:
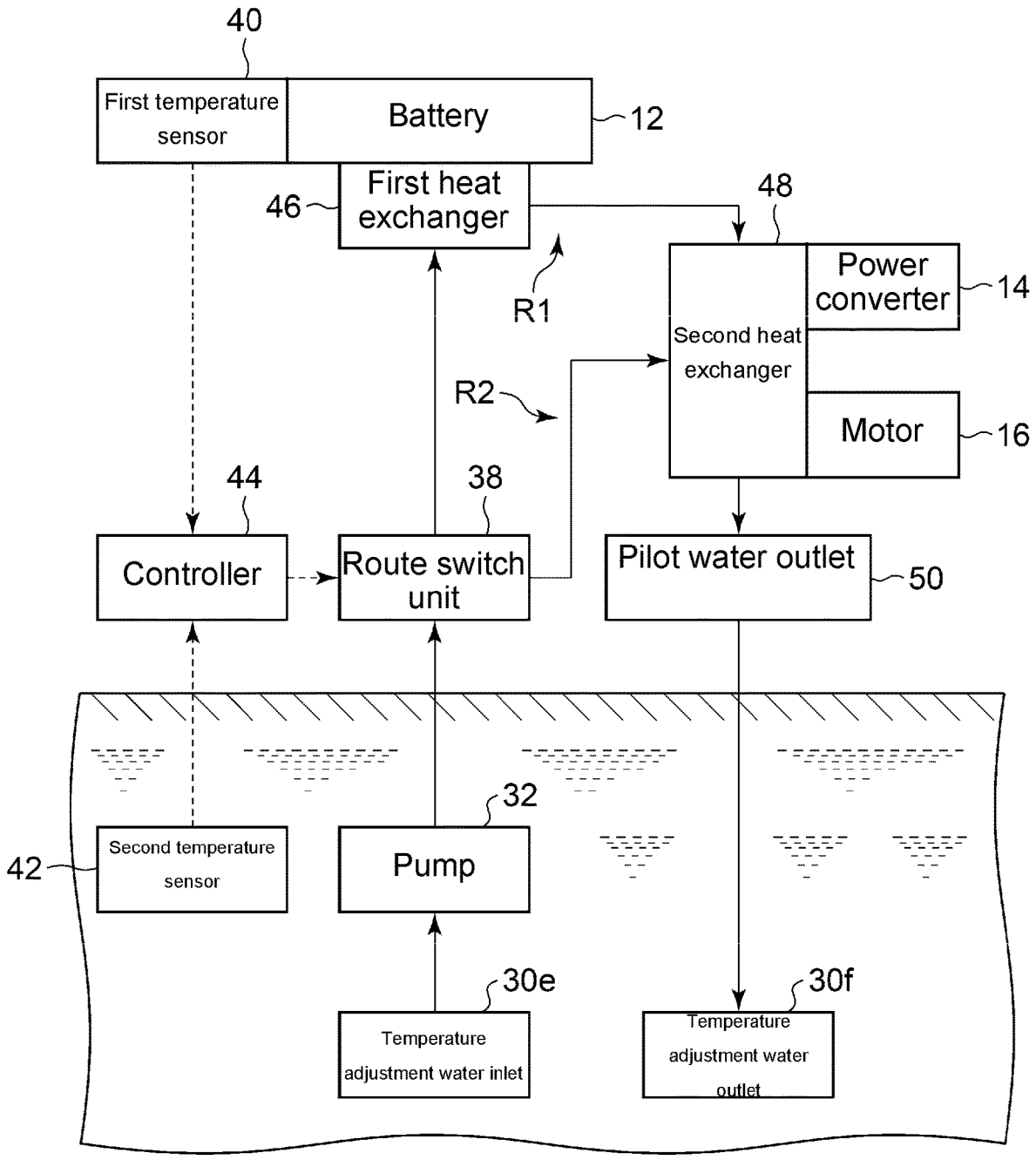
FIG. 4 is a schematic diagram illustrating a flow path configuration of temperature adjustment water included in a ship propulsion device according to a variation.

FIG. 4 is a schematic diagram illustrating a flow path configuration of the temperature adjustment water included in ship propulsion device 1 according to a variation. As illustrated in FIG. 4, in ship propulsion device 1 according to the variation, second heat exchanger 48 is positioned upstream of pilot water outlet 50 in first route R1 and second route R2. Power converter 14 and motor 16 are connected to second heat exchanger 48 in a heat exchangeable manner. In this case, for example, second heat exchanger 48 is configured with part of second flow path 30*b*. Power converter 14 and motor 16 are housed in upper housing 2.

By providing second heat exchanger 48 upstream of pilot water outlet 50, the amount of the temperature adjustment water passing through second heat exchanger 48 can be increased compared to the case where second heat exchanger 48 is provided downstream of pilot water outlet 50. Accordingly, the cooling efficiency of power converter 14 and motor 16 can be increased.

The embodiment may be identified by the following items.

[Item 1] A ship propulsion device (1) including:

a motor (16) which drives a propulsion unit (18);

a battery (12) which supplies electric power to the motor (16);

a temperature-adjustment-water flow path (30) through which water outside a hull (100) flows, the temperature-adjustment-water flow path (30) including a first route (R1) which passes through a first exchanger (46) connected to the battery (12) in a heat exchangeable manner;

a route switch unit (38) switchable between a permitted state and a restricted state, the permitted state permitting a flow of the water to the first route (R1), the restricted state restricting the flow of the water to the first route (R1);

a first temperature sensor (40) which detects a temperature of the battery (12); a second temperature sensor (42) which detects a temperature of the water; and a controller (44) which controls the route switch unit (38) based on the temperature of the battery (12) detected by the first temperature sensor (40) and the temperature of the water detected by the second temperature sensor (42), wherein the controller (44):

sets the route switch unit (38) to the permitted state at least one of (i) when the temperature of the battery (12) exceeds a predetermined upper limit value and the temperature of the water is lower than the temperature of the battery (12) or (ii) when the temperature of the battery (12) is lower than a predetermined lower limit value and the temperature of the water exceeds the temperature of the battery (12); and sets the route switch unit (38) to the restricted state at least one of (i) when the temperature of the battery (12) exceeds the predetermined upper limit value and the temperature of the water exceeds the temperature of the battery (12), or (ii) when the temperature of the battery (12) is lower than the predetermined lower limit value and the temperature of the water is lower than the temperature of the battery (12).

[Item 2] The ship propulsion device (1) according to item 1, including:

a power converter (14) which converts the electric power of the battery (12) and supplies the electric power after conversion to the motor (16), wherein the temperature-adjustment-water flow path (30) includes a second route (R2) which passes through a second heat exchanger (48) without passing through the first exchanger (46), the second heat exchanger (48) being connected to the power converter (14) in a heat exchangeable manner, and the route switch unit (38) permits a flow of the water to the second route (R2) in the restricted state.

[Item 3] The ship propulsion device (1) according to item 2, wherein the first route (R1) passes through the second heat exchanger (48).

[Item 4] A method of adjusting a temperature of a battery (12) provided in a ship propulsion device (1), the method including:

performing heat exchange between water outside a hull (100) and the battery (12) at least one of (i) when the temperature of the battery (12) exceeds a predetermined upper limit value and a temperature of the water is lower than the temperature of the battery (12), or (ii) when the temperature of the battery (12) is lower than a predetermined lower limit value and the temperature of the water exceeds the temperature of the battery (12); and reducing the heat exchange at least one of (i) when the temperature of the battery (12) exceeds the predetermined upper limit value and the temperature of the water exceeds the temperature of the battery (12), or (ii) when the temperature of the battery (12) is lower than the predetermined lower limit value and the temperature of the water is lower than the temperature of the battery (12).

REFERENCE MARKS IN THE DRAWINGS

1 ship propulsion device
12 battery
14 power converter
16 motor
18 propulsion unit
30 temperature-adjustment-water flow path
38 route switch unit
40 first temperature sensor
42 second temperature sensor
44 controller
46 first heat exchanger
48 second heat exchanger
100 hull
R1 first route
R2 second route

The invention claimed is:

1. A ship propulsion device comprising:

a motor which drives a propulsion unit;

a battery which supplies electric power to the motor;

a temperature-adjustment-water flow path through which water outside a hull flows, the temperature-adjustment-water flow path including a first route which passes through a first exchanger connected to the battery in a heat exchangeable manner;

a route switch unit switchable between a permitted state and a restricted state, the permitted state permitting a flow of the water to the first route, the restricted state restricting the flow of the water to the first route;

a first temperature sensor which detects a temperature of the battery;

a second temperature sensor which detects a temperature of the water; and a controller which controls the route switch unit based on the temperature of the battery detected by the first temperature sensor and the temperature of the water detected by the second temperature sensor, wherein the controller:

sets the route switch unit to the permitted state at least one of (i) when the temperature of the battery exceeds a predetermined upper limit value and the temperature of the water is lower than the temperature of the battery or (ii) when the temperature of the battery is lower than a predetermined lower limit value and the temperature of the water exceeds the temperature of the battery;

sets the route switch unit to the restricted state at least one of (i) when the temperature of the battery exceeds the predetermined upper limit value and the temperature of the water exceeds the temperature of the battery, or (ii) when the temperature of the battery is lower than the predetermined lower limit value and the temperature of the water is lower than the temperature of the battery; and a power converter which converts the electric power of the battery and supplies the electric power after the conversion to the motor, wherein the temperature-adjustment-water flow path includes a second route which passes through a second heat exchanger without passing through the first exchanger, the second heat exchanger being connected to the power converter in a heat exchangeable manner, and the route switch unit permits a flow of the water to the second route in the restricted state.

2. The ship propulsion device according to claim 1, wherein the first route passes through the second heat exchanger.

* * * * *